US009298119B2

(12) United States Patent
Yaguchi et al.

(10) Patent No.: US 9,298,119 B2
(45) Date of Patent: Mar. 29, 2016

(54) CARRIER FOR TWO-COMPONENT DEVELOPER, TWO-COMPONENT DEVELOPER USING THE CARRIER, AND IMAGE FORMING METHOD AND PROCESS CARTRIDGE USING THE TWO-COMPONENT DEVELOPER

(71) Applicants: Shigenori Yaguchi, Shizuoka (JP); Koichi Sakata, Shizuoka (JP); Hitoshi Iwatsuki, Shizuoka (JP); Toyoaki Tano, Shizuoka (JP); Hiroyuki Kishida, Shizuoka (JP); Kenichi Mashiko, Shizuoka (JP); Hiroshi Tohmatsu, Shizuoka (JP)

(72) Inventors: Shigenori Yaguchi, Shizuoka (JP); Koichi Sakata, Shizuoka (JP); Hitoshi Iwatsuki, Shizuoka (JP); Toyoaki Tano, Shizuoka (JP); Hiroyuki Kishida, Shizuoka (JP); Kenichi Mashiko, Shizuoka (JP); Hiroshi Tohmatsu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/167,468

(22) Filed: Jan. 29, 2014

(65) Prior Publication Data

US 2014/0248557 A1 Sep. 4, 2014

(30) Foreign Application Priority Data

Mar. 4, 2013 (JP) ..... 2013-042215

(51) Int. Cl.

| | |
|---|---|
| ***G03G 9/113*** | (2006.01) |
| ***G03G 9/107*** | (2006.01) |
| ***G03G 21/18*** | (2006.01) |

(52) U.S. Cl.

CPC ..... *G03G 9/1075* (2013.01); *G03G 9/107* (2013.01); *G03G 9/1131* (2013.01); *G03G 9/1135* (2013.01); *G03G 9/1139* (2013.01); *G03G 21/1803* (2013.01)

(58) Field of Classification Search

CPC ... G03G 9/1133; G03G 9/1131; G03G 9/107; G03G 9/1139; G03G 9/1136; G03G 9/0821

See application file for complete search history.

(56) References Cited

U.S. PATENT DOCUMENTS

| | | | | |
|---|---|---|---|---|
| 5,565,296 | A * | 10/1996 | Kmiecik-Lawrynowicz et al. | 430/111.1 |
| 6,242,146 | B1 * | 6/2001 | Ishihara et al. | 430/110.4 |
| 8,637,218 | B2 | 1/2014 | Sakata et al. | |
| 8,663,892 | B2 * | 3/2014 | Yaguchi et al. | 430/111.32 |
| 8,916,325 | B2 * | 12/2014 | Yaguchi et al. | 430/111.35 |

(Continued)

FOREIGN PATENT DOCUMENTS

| | | |
|---|---|---|
| JP | 11-065247 | 3/1999 |
| JP | 2000-047476 | 2/2000 |

(Continued)

*Primary Examiner* — Hoa V Le

(74) *Attorney, Agent, or Firm* — Oblon, McClelland, Maier & Neustadt, L.L.P.

(57) ABSTRACT

A carrier is provided. The carrier includes a particulate magnetic core, and a cover layer located on the surface of the particulate magnetic core and including a resin and a filler. When determined from observation of cross-section of the carrier, the shape factor SF2 of the carrier is from 120 to 160, the ratio of the average domain diameter of the particulate magnetic core to the number average particle diameter of the filler is from 1:1 to 1:0.003, and the area ratio of the filler in the cover layer is from 30 to 85%.

8 Claims, 5 Drawing Sheets

(56) References Cited

U.S. PATENT DOCUMENTS

| | | | | |
|---|---|---|---|---|
| 2003/0186156 | A1* | 10/2003 | Kayamoto et al. | 430/111.32 |
| 2006/0127793 | A1* | 6/2006 | Hotta et al. | 430/111.33 |
| 2010/0233608 | A1* | 9/2010 | Tsurumi et al. | 430/108.6 |
| 2011/0171573 | A1* | 7/2011 | Sakata et al. | 430/111.1 |
| 2012/0064451 | A1* | 3/2012 | Kishida et al. | 430/111.1 |
| 2013/0040236 | A1* | 2/2013 | Fukushima et al. | 430/125.3 |
| 2013/0252169 | A1 | 9/2013 | Yaguchi et al. | |
| 2014/0023966 | A1 | 1/2014 | Sawada et al. | |
| 2014/0072910 | A1 | 3/2014 | Iwatsuki et al. | |

FOREIGN PATENT DOCUMENTS

| | | |
|---|---|---|
| JP | 2004-133178 | 4/2004 |
| JP | 2005-215397 | 8/2005 |
| JP | 2007-086721 | 4/2007 |
| JP | 2007-248960 | 9/2007 |
| JP | 2009-186655 | 8/2009 |
| JP | 2009-282082 | 12/2009 |
| JP | 2009-282209 | 12/2009 |
| JP | 2011-145388 | 7/2011 |
| JP | 2012-083715 | 4/2012 |
| JP | 2012-177873 | 9/2012 |

* cited by examiner

CARRIER FOR TWO-COMPONENT DEVELOPER, TWO-COMPONENT DEVELOPER USING THE CARRIER, AND IMAGE FORMING METHOD AND PROCESS CARTRIDGE USING THE TWO-COMPONENT DEVELOPER

CROSS-REFERENCE TO RELATED APPLICATIONS

This patent application is based on and claims priority pursuant to 35 U.S.C. §119 to Japanese Patent Application No. 2013-042215 filed on Mar. 4, 2013 in the Japan Patent Office, the entire disclosure of which is hereby incorporated by reference herein.

TECHNICAL FIELD

This disclosure relates to a carrier for use in two-component developer for developing an electrostatic latent image. In addition, this disclosure relates to a two-component developer including the carrier. Further, this disclosure relates to an image forming method and a process cartridge using the two-component developer.

BACKGROUND

Electrophotographic image formation typically includes the following processes:

(1) forming an electrostatic latent image on an image bearing member such as photoreceptor;

(2) adhering a charged toner to the electrostatic latent image to form a toner image on the image bearing member:

(3) transferring the toner image onto a recording medium optionally via an intermediate transfer medium; and (4) fixing the toner image to the recording medium to output an image.

Recently, electrophotographic image forming apparatuses have been rapidly changed from monochrome image forming apparatuses to full color image forming apparatuses, and the market scale of full color image forming apparatuses has been expanded.

In full color image formation, three color images such as yellow, magenta and cyan color toner images or four color images such as yellow, magenta, cyan and black color toner images are overlaid to form a full color image.

With respect to the developing method used for such image forming apparatuses, one-component developing methods, two-component developing methods, and hybrid developing methods have been conventionally used. In this regard, in order to produce full color images having a good combination of color reproducibility and clearness, the amounts of color toners constituting color toner images are preferably proportional to the potentials of the electrostatic latent images of the color images. Therefore, among the above-mentioned developing methods, two-component developing methods have been widely used from this point of view. If the amounts of color toners constituting color toner images vary even when the potentials of the electrostatic latent images of the color images do not vary, problems such that the image density and color tones of the color images vary occur.

The factors of variation of the amounts of color toners constituting color toner images on an image bearing member include factors such that the charge quantities of the toners and/or the electric resistances of the developers vary. In addition, it is known that there is a phenomenon such that a toner image is affected by history of images previously formed on the image bearing member (i.e., ghost images of previously formed images are formed).

In order to release a developer from a developer bearing member, a technique is generally used in which odd numbers of magnets are arranged inside a development sleeve (i.e., developer bearing member) in such a manner that a pair of magnets having the same polarity are arranged below the rotation axis of the development sleeve to form a developer releasing region in which the magnetic force is substantially zero so that the developer naturally falls after being used for development. However, since the toner in the developer is used for developing an electrostatic latent image and thereby a counter charge is formed in the carrier in the developer, an image force is generated between the carrier and the developer bearing member, and thereby the developer is not normally separated from the developer releasing region of the developer bearing member in which the developer releasing pole is present. Therefore, the developer including the toner at a low concentration is fed again to the development region due to rotation of the development sleeve, thereby deteriorating the developing ability of the developer, resulting in formation of a low density image. Specifically, as illustrated in FIG. 7B, a front end image portion 91*s*, which is formed by the developer when the development sleeve is rotated one revolution, has a normal image density, but image portions 91*a*1, 91*a*2, and 91*a*3, which are formed by the developer (including the toner at a low concentration) after the development sleeve is rotated one revolution, have a relatively low image density.

In attempting to solve the problem, JP-H11-65247-A proposes a technique such that a developer drawing roller including a magnet inside thereof is arranged in the vicinity of the developer releasing region of the development sleeve to separate the developer, which has been used for development, by the magnetic force thereof. However, formation of ghost images is not caused only by defective releasing of a two-component developer. In other words, even when releasing of a two-component developer is normally performed, ghost images can be formed.

In addition, as a developer is used for development, a spent toner problem in that a film of toner is formed on the surface of the carrier of the developer, and thereby the charge quantity of the toner is changed is often caused. In attempting to prevent occurrence of the spent toner problem, a carrier coated with a resin layer having good water repellency is used, or a developing device in which a new carrier is supplied together with toner while the used carrier in the developing device is discharged to prevent variation of the charge quantity of the toner is used. The spent toner problem is typically caused when a large amount of toner is used for development while a large amount of new toner is supplied, i.e., when images with a high image area proportion are formed.

In addition, a problem in that the cover layer of a coated carrier is abraded by stress caused by agitation of the developer in a developing device is often caused particularly when images with a low image area proportion are formed. If the cover layer is abraded and the core of the carrier is revealed, a problem (hereinafter sometimes referred to as a resistance decreasing problem) in that the electric resistance of the carrier decreases, resulting in variation of image density is caused.

The present inventors recognize that a need exists for a carrier which hardly causes the spent toner problem even when images with a high image area proportion are formed and which hardly causes the resistance decreasing problem even when images with a low image area proportion are formed.

SUMMARY

As an aspect of this disclosure, a carrier is provided which includes a particulate magnetic core and a cover layer which is located on the surface of the particulate magnetic core and which includes a resin and a filler. When determined from observation of cross-section of the carrier, the carrier has a shape factor SF2 of from 120 to 160, the area ratio of the filler in the cover layer is from 30 to 85%, and the ratio of the average domain diameter of the particulate magnetic core to the number average particle diameter of the filler is from 1:1 to 1:0.003.

As another aspect of this disclosure, a two-component developer is provided which includes the above-mentioned carrier and a toner.

As another aspect of this disclosure, an image forming method is provided which includes forming an electrostatic latent image on a surface of an image bearing member, developing the electrostatic latent image with the above-mentioned developer to form a toner image on the surface of the image bearing member, transferring the toner image onto a recording medium, and fixing the toner image to the recording medium.

As another aspect of this disclosure, a process cartridge is provided which includes an image bearing member to bear an electrostatic latent image on a surface thereof, and a developing device to develop the electrostatic latent image with the above-mentioned developer to form a toner image on the surface of the image bearing member, wherein the image bearing member and the developing device are integrated into a single unit so that the process cartridge is detachably attachable to an image forming apparatus.

The aforementioned and other aspects, features and advantages will become apparent upon consideration of the following description of the preferred embodiments taken in conjunction with the accompanying drawings.

DETAILED DESCRIPTION

Figure 1:
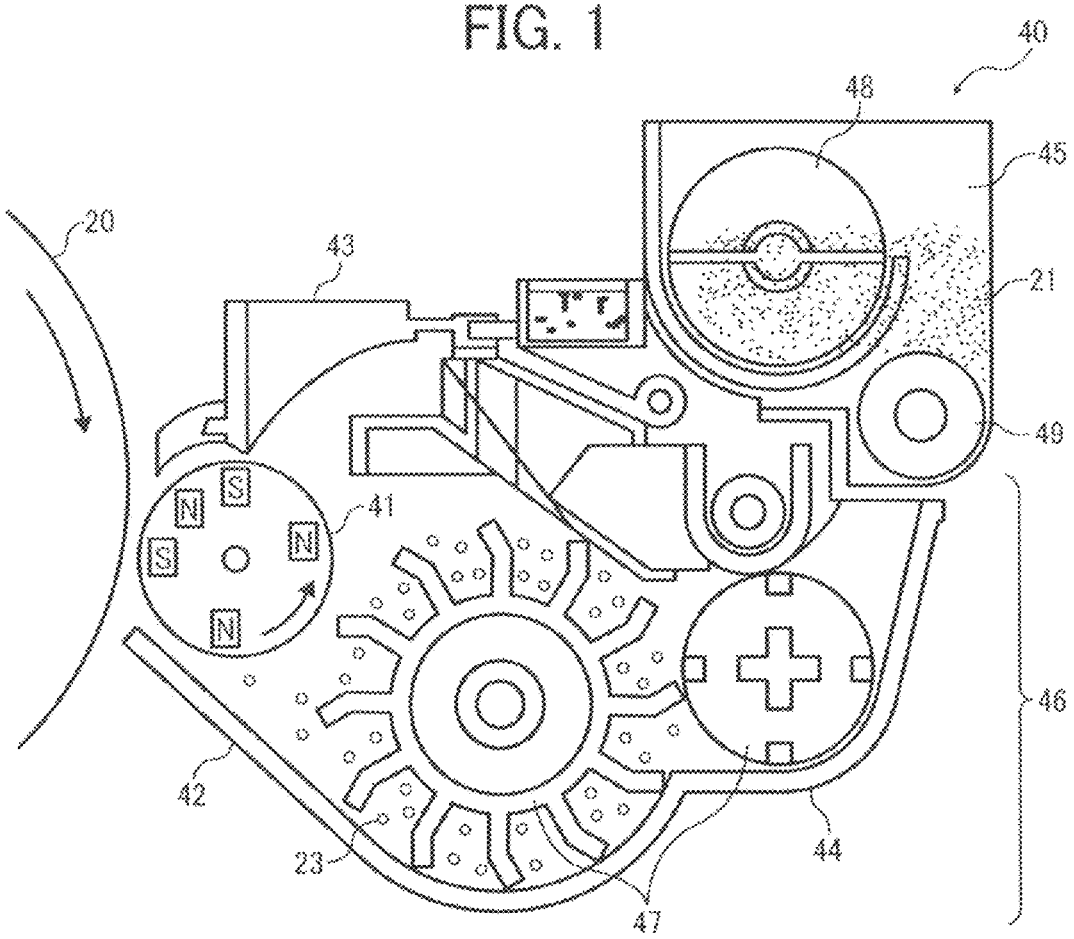
FIG. 1 is a schematic view illustrating a developing device for use in an image forming method according to an embodiment.

The object of this disclosure is to provide a carrier which can provide a developer, which hardly forms ghost images because the developer is not affected by the history of images previously formed on an image bearing member and which hardly causes the spent toner problem even when images with a high image area proportion are formed and hardly causes the resistance decreasing problem even when images with a low image area proportion are formed.

The carrier of this disclosure includes a particulate magnetic core and a cover layer which is located on the surface of the particulate magnetic core and which includes a resin and a filler. When determined from observation of cross-section of the carrier, the carrier has a shape factor SF2 of from 120 to 160, the area ratio of the filler in the cover layer is from 30 to 85%, and the ratio of the average domain diameter of the particulate magnetic core to the number average particle diameter of the filler is from 1:1 to 1:0.003.

The core revealing rate, which is defined as the ratio of the length of an uncovered surface of the magnetic core to the perimeter of the magnetic core and which is determined from the cross section of the carrier, is preferably not greater than 10%.

The number average particle diameter of the filler, which is determined from the cross section of the carrier, is preferably from 50 nm to 800 nm.

The resin of the cover layer preferably includes a silicone resin.

The developer of this disclosure includes the above-mentioned carrier and a toner.

The image forming method of this disclosure includes a process of forming an electrostatic latent image on a surface of an image bearing member, a process of developing the electrostatic latent image with the above-mentioned developer to form a toner image on the surface of the image bearing member, a process of transferring the toner image onto a recording medium, and a process of fixing the toner image to the recording medium.

The process cartridge of this disclosure includes an image bearing member to bear an electrostatic latent image on a surface thereof, and a developing device to develop the electrostatic latent image with the above-mentioned developer to form a toner image on the surface of the image bearing member. The image bearing member and the developing device are integrated into a single unit so that the process cartridge is detachably attachable to an image forming apparatus.

The mechanism of formation of ghost images to be solved by this disclosure is different from the mechanism of formation of the above-mentioned ghost images caused by defective releasing of developer from a developer bearing member. The mechanism of formation of ghost images to be solved by this disclosure is not yet clarified, but is considered to be as follows. Specifically, the amount of toner adhered to a developer bearing member varies depending on the history of images previously formed on the image bearing member, and thereby the potential of the toner on the developer bearing member is changed. Therefore, the amount of the toner adhered to the next electrostatic latent image on the image bearing member changes due to change of the potential of the toner. Namely, the amount of the toner adhered to the next electrostatic latent image on the image bearing member varies depending on the history of images previously formed on the image bearing member.

More specifically, since a bias is applied to a development sleeve (developer bearing member), toner in the developing device is adhered to the developer bearing member, i.e., development using the toner is performed on the surface of the developer bearing member. Namely, the toner on the image bearing member has a higher potential, and therefore the development potential is increased due to the higher potential of the toner when an electrostatic latent image is developed. Therefore, the amount of the toner adhered to the electrostatic latent image is increased. In this regard, since the toner adhered to the surface of the developer bearing member is used for developing the electrostatic latent image, the amount of the toner on the developer bearing member is not constant and varies depending on the history of images previously formed on the image bearing member. When no image is formed as the last image or at an interval of development between two adjacent recording medium sheets passing through the development region, development using the toner is performed on the surface of the developer bearing member, and therefore the image density of the next image is high. In contrast, when an image with a high image area proportion is formed as the last image, the amount of toner used for development is large, and therefore the amount of toner on the developer bearing member is small, resulting in decrease of the image density of the next image.

Thus, the phenomenon of formation of ghost images to be solved by this disclosure is considered to be a phenomenon in that the amount of toner on a developer bearing member varies depending on the history of images (the last image), and thereby the image density of the next image is varied.

As a result of the present inventors' diligent research, it is found that when the carrier has such a configuration as mentioned above, the above-mentioned problem can be solved. The mechanism is not yet determined, but is considered to be as follows.

Specifically, when the core of the carrier has a shape factor SF2 of from 120 to 160, the bulk density of the carrier covered with a cover layer can be decreased. In general, a core having a large shape factor SF2 has a rough surface, and in addition the number of voids present in the core is large. Therefore, the bulk density of the core decreases. Assuming that the number of carrier particles fed to the development nip formed by an image bearing member and a developer bearing member is constant, the volume of a developer having a low bulk density in the development nip is relatively large compared with a developer having a high bulk density. In this case, the packing density of the developer having a low bulk density at the development nip is relatively high compared with that of the developer having a high bulk density. Namely, the occupancy of the carrier of the developer having a low bulk density in the development nip is relatively high compared to the occupancy of the carrier of the developer having a high bulk density. Therefore, when the core has a shape factor SF2 of from 120 to 160, the effective electric resistance of the development nip formed by the image bearing member and the developer bearing member can be decreased, and therefore the toner on the developer bearing member, which is adhered to the developer bearing member when no image is formed on the image bearing member, is consumed in a proper amount for development. Namely, the amount of toner on the developer bearing member can be stabilized independently of the last image, and therefore images with good evenness can be stably produced.

The shape factor SF2 of the core of the carrier of this disclosure is from 120 to 160, and more preferably from 130 to 160. When the shape factor SF2 is less than 120, the bulk density of the carrier increases, and therefore it becomes hard to decrease the effective electric resistance of the developer at the development nip. In contrast, when the SF2 is greater than 160, the number of voids in the core excessively increases, resulting in deterioration of mechanical strength of the core and decrease of magnetization per one particle of the core. When a carrier including a core with a shape factor SF2 of greater than 160 is used for a developing device for a long period of time, many of projected portions of the core are revealed, and thereby the electric resistance of the carrier is decreased. In this regard, if a relatively thick cover layer is formed on such a core, decrease of the electric resistance can be prevented, but the magnetization per one particle of the carrier decreases, thereby often causing a carrier adhesion problem in that carrier particles adhere to an electrostatic latent image on an image bearing member.

The shape and domain diameter of a core, and the particle diameter of a filler included in the cover layer can be determined by observing the cross section of a cut carrier particle. In this regard, carrier particles in a photograph, which have a cross section having an average biaxial diameter in a range of D±5 μm (D represents the average particle diameter of the carrier), are sampled to determine the shape and domain diameter of the core, and the particle diameter of the filler. The average particle diameter D of the carrier means the 50% integration particle diameter d50 (median diameter) in a particle diameter distribution curve obtained by a laser diffraction scatter method. Namely, carrier particles which are cut in the vicinity of the center thereof are observed.

In this application, the shape factor SF2 and the average domain diameter of the core, the number average particle diameter and the area ratio of the filler, and the revealing rate of the core are defined as follows.

1. Shape Factor SF2

Cross sections of carrier particles are observed with a Field Emission Scanning Electron Microscope (FE-SEM), S-800 from Hitachi Ltd, at a 5,000 power magnification. Among the cross-section images, 100 images are randomly sampled, and the sampled cross-section images are analyzed using an image analyzer (LUZEX AP from Nireco Corporation and an interface. The SF2 of a particle is calculated from the following equation (1):

$$SF2=(P^2/A)\times(1/4\pi)\times 100 \quad (1),$$

wherein P represents the peripheral length of the particle, and A represents the area of the projected image of the particle.

The shape factor SF2 represents the degree of surface asperity of a particle, and the greater the degree of surface asperity of a particle (i.e., the greater the surface roughness of a particle), the greater the shape factor SF2 of the particle.

2. Average Domain Diameter of Core

Figure 8:
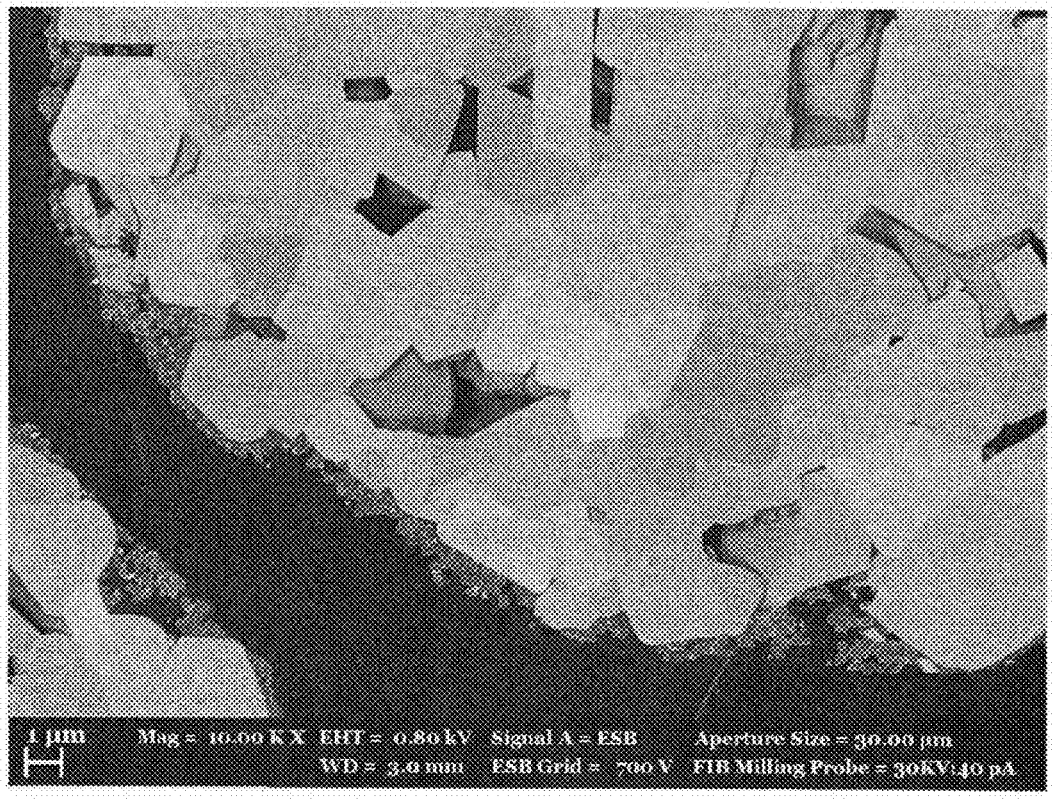
FIG. 8 is a photograph illustrating the cross-section of a carrier taken by a Field Emission Scanning Electron Microscope (FE-SEM) of 10,000 power magnification.

The average biaxial particle diameter of domains in twenty cross-section images of carrier particles taken by the FE-SEM at a 5,000 power magnification is calculated to determine the number average particle diameter of domains in the core of the carrier particles, which is the average domain diameter. In this regard, a domain means a portion which has an irregular shape such as bar shape, square shape and trapezoidal shape, and has a white or gray color in FIG. 8.

3. Number Average Particle Diameter of Filler

The cover layer of carrier particles is observed with the FE-SEM at a power magnification of from 10,000 to 50,000. This observation is performed with respect to 20 viewing fields to determine the number average particle diameter (average biaxial particle diameter) of the filler included in the cover layer.

4. Area Ratio of Filler

The cover layer of carrier particles is observed with the FE-SEM at a power magnification of from 10,000 to 50,000. This observation is performed with respect to 20 viewing fields to determine the area ratio of the filler, i.e., the ratio of the total area of the filler included in the cover layer to the total area of the cover layer.

5. Revealing Rate of Core

The cover layer of carrier particles is observed with the FE-SEM at a power magnification of from 10,000 to 50,000 to determine the revealing rate of the core, i.e., the ratio of the length of the uncovered surface of the core to the perimeter of the core.

Core materials having an average domain diameter of from 1 μm to 10 μm, an average particle diameter of from 10 μm to 80 μm, and a BET specific surface area of from 0.06 to 0.25 $m^2/g$ are preferably used for the core of the carrier of this disclosure. In addition, the ratio of the average domain diameter of the core to the number average particle diameter of the filler included in the cover layer is preferably from 1:1 (1/1) to 1:0.003 (1/0.003). When the ratio is greater than 1/0.003, the mechanical strength of the cover layer tends to deteriorate. In this case, the cover layer is easily abraded after repeated use, and therefore the revealing rate of the core increases, thereby largely changing the electric resistance of the carrier so as to be largely different from the initial electric resistance. Therefore, the amount of toner adhered to an electrostatic latent image on an image bearing member changes while the way of adhesion of the toner to the image bearing member also changes, resulting in variation of image quality. In contrast, when the ratio is less than 1/1, it becomes difficult to fix the filler on the surface of the carrier, and in addition a problem in that the filler is released from the surface of the carrier is often caused when the developer is agitated in a developing device.

The material of the core is not particularly limited as long as the material is a magnetic material. Specific examples of the material include ferromagnetic metals such as iron and cobalt; iron oxides such as magnetite, hematite and ferrite; various metal alloys and compounds including such a ferromagnetic metal; and particulate resins in which such a magnetic material is dispersed. Among these materials, Mn-based ferrites, Mn—Mg-based ferrites, Mn—Mg—Sr-based ferrites are preferable because of being environmentally friendly.

The cover layer is preferably formed in such a manner that the convexes and concaves of the surface of the core remain on the surface of the resultant coated carrier. The carrier with the cover layer preferably has a BET specific surface area of from 0.5 to 3.0 $m^2/g$.

The area ratio of the filler is preferably from 30 to 85%. When this condition is satisfied, abrasion of the cover layer can be prevented even when the carrier is used in a developing device over a long period of time. When the area ratio is less than 30%, the cover layer abrasion preventing effect is hardly produced. In this case, the revealing rate of the core increases after long repeated use, and the electric resistance of the developer decreases, thereby causing a problem in that the image quality varies and the carrier adhesion problem. In contrast, when the area ratio is greater than 85%, the ratio of the filler on the surface of the carrier excessively increases, thereby deteriorating the release effect of the resin included in the cover layer, resulting in occurrence of the spent toner problem. As mentioned above, the area ratio of the filler can be quantified by using an image analyzer.

The number average particle diameter of the filler in the cover layer, which can be determined by the above-mentioned method, is preferably from 50 nm to 800 nm. In this case, the filler is projected from the surface of the cover layer, and thereby portions having a low electric resistance can be formed on the surface of the carrier while good abrasion resistance can be imparted to the carrier. In addition, spent toner on the surface of a carrier particle can be scraped off by the filler on the surface of another carrier particle, thereby preventing occurrence of the spent toner problem.

Electroconductive fillers, non-electroconductive fillers, and combinations thereof can be used for the filler.

Particulate electroconductive materials are preferably used for the electroconductive filler, and specific examples thereof include aluminum oxide, titanium dioxide, zinc oxide, silicon dioxide, barium sulfate and zirconium oxide, on which an electroconductive layer of tin dioxide or indium oxide is formed; and carbon black.

Specific examples of the non-electroconductive fillers include aluminum oxide, titanium dioxide, zinc oxide, silicon dioxide, barium sulfate and zirconium oxide.

Since the cover layer is too thin, the surface of the core of the carrier is easily revealed after repeatedly agitated in a developing device, thereby enlarging variation of the electric resistance of the carrier. Therefore, the thickness of the cover layer preferably falls in a proper thickness range. However, the proper thickness of the cover layer changes depending on factors such as the life of the carrier (whether the carrier is used as a long life carrier or a short life carrier) and the size of the filler included in the cover layer, and therefore the proper thickness of the cover layer cannot be unambiguously determined.

The revealing rate of the core is preferably not greater than 10%. The revealing rate of the core largely varies depending on the method for forming the cover layer. However, when a fluidized bed type coating device is used, the cover layer can be satisfactorily formed without affecting the asperity of the surface of the core, and therefore the revealing rate can be controlled by controlling the coating amount of the cover layer coating liquid.

The resin of the cover layer preferably includes a silicone resin. Specifically, the cover layer is preferably prepared by using a cover layer composition liquid including a silicone resin having a silanol group and/or a hydrolyzable functional group, a polymerization catalyst, a solvent, and an optional resin other than the silicone resin having a silanol group and/or a hydrolyzable functional group.

Specifically, a method in which a cover layer composition liquid (coating liquid) is applied on a particulate core while condensing the silanol group of the silicone resin, or a method in which after the cover layer composition liquid is applied on a particulate core, the silanol group of the silicone resin is condensed can be used. Specific examples of the former method include a method in which a cover layer composition liquid is applied on a particulate core while applying heat or light thereto to condense the silanol group of the silicone resin in the composition liquid. Specific examples of the latter method include a method in which after a cover layer composition liquid is applied on a particulate core, the applied composition liquid is heated to condense the silanol group of the silicone resin in the composition liquid.

Specific examples of the resins for use in the cover layer other than silicone resins having a silanol group and/or a hydrolyzable group include acrylic resins, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and vinyl fluoride, fluoroterpolymers such as terpolymers of tetrafluoroethylene, vinylidene fluoride and a non-fluorinated monomer, silicone resins which do not have a silanol group or a hydrolyzable group, etc. These resins can be used alone or in combination.

In addition, the cover layer can include a crosslinked material prepared by hydrolyzing a copolymer having the following formula (1) to generate a silanol group and then condensing the resin.

(1)

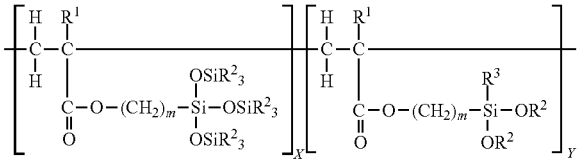

In formula (1), $R^1$ represents a hydrogen atom or a methyl group, $R^2$ represents an alkyl group having 1 to 4 carbon atoms, $R^3$ represents an alkyl group having 1 to 8 carbon atoms or an alkoxyl group having 1 to 4 carbon atoms, m is an integer of from 1 to 8, and X and Y respectively represent molar ratios of the repeat units, wherein each of X and Y is from 10% by mole to 90% by mole.

The cover layer composition liquid preferably includes a silane coupling agent to stably disperse the filler in the cover layer composition liquid.

Specific examples of such a silane coupling agent, include, but are not limited thereto, γ-(2-aminoethyl)aminopropyltrimethoxysilane, γ-(2-aminoethyl)aminopropyldimethoxysilane, γ-methacryloxypropyltrimethoxysilane, N-β-(N-vinylbenzylaminoethyl)-γ-aminopropyltrimethoxysilane) hydrochloride, γ-glycidoxypropyltrimethoxysilane, γ-mercaptopropyltrimethoxysilane, methyltrimethoxysilane, methyltriethoxysilane, vinyltriacetoxylsilane, γ-chloropropyltrimethoxysilane, hexamethyldisilazane, γ-anilinopropyltrimethoxysilane, vinyltrimethoxylsilane, octadecyldimethyl [3-(trimethoxysilyl)propyl]ammonium chloride, γ-chloropropylmethyldimethoxysilane, methyltrichlorosilane, dimethyldichlorosilane, trimethylchlorosilane, allyltrimethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl)ammonium chloride. These silane coupling agents can be used alone or in combination.

Specific examples of marketed silane coupling agents include AY43-059, SR6020, SZ6023, SH6026, SZ6032, SZ6050, AY43-310M, SZ6030, SH6040, AY43-026, AY43-031, SH6062, Z-6911, SZ6300, SZ6075, SZ6079, SZ6083, SZ6070, SZ6072, Z-6721, AY43-004, Z-6187, AY43-021, AY43-043, AY43-040, AY43-047, Z-6265, AY43-204M, AY43-048, Z-6403, AY43-206M, AY43-206E, Z-6341, AY43-210MC, AY43-083, AY43-101, AY43-013, AY43-158E, Z-6920, and Z-6940, which are from Toray Silicone Co., Ltd.

The amount of a silane coupling agent included in the cover layer composition liquid is preferably from 0.1 to 10 parts by weight based on 100 parts by weight of a resin included in the cover layer composition liquid. When the added amount is less than 0.1 parts by weight, adhesion of the resin to the core and the filler tends to deteriorate, resulting in peeling of the cover layer from the core after long repeated use. In contrast, adding a silane coupling agent in an amount of greater than 10 parts by weight often causes the toner filming problem (spent toner problem) after long repeated use.

The carrier of this disclosure is mixed with a toner to be used as a two-component developer. Any known toners such that a colorant, a particulate material, a charge controlling agent, a release agent and the like are dispersed in a binder resin such as a thermoplastic resin can be used. The toner can be prepared by a method such as pulverization methods, polymerization methods and granulation methods, and particles of the toner can have irregular form or spherical form. In addition, the toner may be a magnetic toner or a non-magnetic toner.

Specific examples of the resins for use as the binder resin of the toner include homopolymers of styrene and substituted styrene such as polystyrene and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers; acrylic resins such as polymethyl methacrylate, and polybutyl methacrylate; and other resins such as polyvinyl chloride, polyvinyl acetate, polyethylene, polypropylene, polyesters, polyurethane resins, epoxy resins, polyvinyl butyral resins, polyacrylic acid resins, rosin, modified rosins, terpene resins, phenolic resins, aliphatic or alicyclic hydrocarbon resins, aromatic petroleum resins, chlorinated paraffin, paraffin waxes, etc. These resins are used alone or in combination.

By using a polyester resin as a binder resin, the resultant toner can have relatively good preservation stability and low melt viscosity compared with those of toners including a styrene resin or an acrylic resin as a binder resin.

Such polyester resins can be prepared by subjecting an alcohol and a carboxylic acid to a polycondensation reaction.

Diols and polyols can be used as the alcohol component for use in preparing such polyester resins. Specific examples of the diols include diols such as diethylene glycol, triethylene glycol, polyethylene glycol, 1,2-propylene glycol, 1,3-propylene glycol, 1,4-butanediol, neopentyl glycol, and 1,4-butenediol; 1,4-bis(hydroxymethyl)cyclohexane, bisphenol A, hydrogenated bisphenol A, etherified bisphenol A such as polyoxyethylenated bisphenol A and polyoxypropylenated bisphenol A, etc. Those diols can be substituted with a saturated or unsaturated hydrocarbon group having from 3 to 22 carbon atoms.

Specific examples of the polyhydric alcohols having three or more hydroxyl groups for use in preparing such polyester resins include sorbitol, 1,2,3,6-hexanetetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-metyl-1,2,4-butanetriol, trimethylol ethane, trimethylol propane, 1,3,5-trihydroxymethyl benzene, etc.

Monocarboxylic acids, dicarboxylic acids, and polycarboxylic acids having three or more carboxyl groups can be used for the carboxylic acid component for use in preparing the above-mentioned polyester resins.

Specific examples of the monocarboxylic acids include palmitic acid, stearic acid, oleic acid, etc. Specific examples of the dicarboxylic acids include dibasic organic acids such as maleic acid, fumaric acid, mesaconic acid, citraconic acid, terephthalic acid, cyclohexane dicarboxylic acid, succinic acid, adipic acid, sebacic acid, malonic acid, etc.; substituted dibasic organic acids in which the above-mentioned dibasic organic acids are substituted with a saturated or unsaturated hydrocarbon group having from 3 to 22 carbon atoms; anhydrides and lower alkyl esters of the above-mentioned dibasic organic acids; dimmer acids of linolenic acid; etc.

Specific examples of the polycarboxylic acids having three or more carboxyl groups include 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxyic acid, 1,2,5-hexane tricarboxyic acid, 1,3-dicarboxyl-2-methyl-2-carboxymethyl propane, tetra (methylenecarboxyl) methane, 1,2,7,8-octane tetracarboxylic acid, EMPOL trimer acid, anhydrides of these acids, etc.

When a crystalline polyester resin is used in combination with a polyester resin, the low temperature fixability of the toner can be further enhanced, and glossiness of images can be enhanced even when toner images are fixed at a relatively low fixing temperature. Crystalline polyester resins can perform crystal transformation at the glass transition temperature thereof, and have a property such that the state thereof rapidly changes from a solid state to a melt state having a relatively low viscosity at the glass transition temperature, thereby exhibiting good fixing property to recording media such as paper. In this regard, crystalline polyester resins are defined polyester resins which have a property such that the ratio of the softening point thereof to the highest endothermic peak temperature in the differential scanning calorimetry (DSC) curve thereof is from 0.6 to 1.5, and preferably from 0.8 to 1.2. The added amount of such a crystalline polyester resin is preferably from 1 to 35 parts by weight, and more preferably from 1 to 25 parts, based on 100 parts by weight of a polyester resin included in the toner. When the added amount of such a crystalline polyester resin is too large, the toner tends to easily cause the filming problem, and the preservation stability of the toner tends to deteriorate.

Specific examples of the epoxy resins for use in the toner include polycondensation products of bisphenol A and epichlorohydrin. Specific examples of the marketed products of the epoxy resins include EPOMICs R362, R364, R365, R366, R367 and R369 (from Mitsui Petrochemical Industries, Ltd.); EPOTOHTOs YD-011, YD-012, YD-014, YD-904 and YD-017 (from TOHTO KASEI Co., Ltd.); and EPOCOTEs 1002, 1004 and 1007 (from Shell Petroleum Co.).

The colorant for use in the toner is not particularly limited. Specific examples thereof include carbon black, lamp black, iron black, ultramarine, Nigrosine dyes, Phthalocyanine Blue, HANSA YELLOW G, Rhodamine 6G Lake, chalco-oil blue, Chrome Yellow, quinacridone, Benzidine quinacridone, Benzidine Yellow, Rose Bengal, triaryl methane dyes, monoazo dyes and pigments, and disazo dyes and pigments. These colorants can be used alone or in combination so that the resultant toner can have a desired color tone.

When the toner is used as a transparent toner, no colorant is included in the toner.

A magnetic material can be used as a black colorant. In this case, the toner is a magnetic toner. Specific examples of the magnetic material include powders of ferromagnetic materials such as iron and cobalt; and powders of magnetite, hematite, Li-containing ferrite, Mn—Zn ferrite, Cu—Zn ferrite, Ni—Zn ferrite, and Ba ferrite.

In order to control the frictional charge property of the toner, a charge controlling agent can be included in the toner. Specific examples thereof include metal complexes of monoazo dyes, nitrohumic acid and salts thereof, metal (such as Co, Cr and Fe) complexes of dicarboxylic acids such as salicylic acid, and naphthoic acid, amino compounds, quaternary ammonium compounds, and organic dyes.

White or transparent materials such as white salicylic acid metal salts are preferably used as charge controlling agents of color toners except for black toner.

The toner optionally includes a release agent. Specific examples thereof include low molecular weight polypropylene, low molecular weight polyethylene, carnauba wax, microcrystalline wax, jojoba wax, rice wax, and montan wax. These can be used alone or in combination.

The toner preferably has good fluidity to produce high quality images. In order to impart good fluidity to toner, it is effective to add an external additive such as particles of hydrophobized metal oxides, and particles of lubricants such as particulate resins and metal soaps.

Specific examples of such external additives include lubricants such as fluorine-containing resins such as polytetrafluoroethylene, and lubricants such as zinc stearate; abrasives such as cerium oxide and silicon carbide; fluidizers such as inorganic oxides such as silica and titanium oxide, which are hydrophobized; caking preventing agents; and surface treated materials of these materials. Among these materials, hydrophobized silica is preferable.

The weight average particle diameter of the toner, which is measured with an instrument MULTISIZER III from Beckman Coulter Inc., is preferably from 3.0 μm to 9.0 μm, and more preferably from 3.0 μm to 7.0 μm.

The carrier of this disclosure can be used for an image forming apparatus in which a supplementary developer including a carrier and a toner is supplied to a developing device while discharging excess developer from the developing device. By using such a developing device, high quality images can be produced over a long period of time. Specifically, by replacing the used carrier (deteriorated carrier) in the developing device with a new carrier in the supplementary developer, the charge quantity of the developer can be stably maintained over a long period of time, thereby making it possible to produce high quality images.

This developing method is particularly effective for producing images with a high image area proportion. The main factor of deterioration of image quality when such images with a high image area proportion are produced is deterioration of charging ability of the carrier due to occurrence of the spent toner problem. By using the method, the amount of the carrier supplied to the developing device can be increased when images with a high image area proportion are produced, and therefore the frequency of replacement of the carrier can be increased, thereby making it possible to produce high quality images over a long period of time.

The supplementary developer preferably includes the carrier (C) of this disclosure and a toner (T) in a weight ratio (C/T) of from 1/2 to 1/50, and more preferably from 1/5 to 1/12. When the weight ratio (C/T) is greater than 1/2, the carrier is supplied in an excessive amount, and therefore the concentration of the carrier in the developer in the developing device excessively increases, thereby excessively increasing the charge quantity of the toner. In this case, the developing ability of the developer deteriorates, and therefore image density decreases. In contrast, if the weight ratio (C/T) is less than 1/50, the amount of the carrier in the supplementary developer decreases, and therefore the frequency of replacement of the carrier decreases, thereby making it impossible to prevent deterioration of the carrier in the developing device.

FIG. 1 is a schematic view illustrating a developing device for use in the image forming apparatus of this disclosure, for which the developer of this disclosure can be used. The developing device is not limited thereto, and modifications can be made thereto.

Referring to FIG. 1, a developing device 40 is arranged so as to be opposed to a photoreceptor 20 serving as an image bearing member. The developing device 40 includes, as main components, a developing sleeve 41, a developer containing portion 46 including a developer container 42 and a support case 44, and a doctor blade 43 serving as a regulating member.

A toner hopper 45 serving as a toner container is connected with the support case 44, which has an opening on the photoreceptor side thereof. The developer containing portion 46, which is located in the vicinity of the toner hopper 45, contains a two-component developer (the developer of this disclosure) including a toner 21 and a carrier 23, which is the carrier of this disclosure, and has developer agitators 47 to agitate the developer to impart frictional/separating charges to particles of the toner 21.

In the toner hopper 45, a toner agitator 48 and a toner supplying member 49, which are rotated by a driving device, are arranged. The toner agitator 48 and the toner supplying member 49 supply the toner 21 in the toner hopper 45 to the developer containing portion 46 while agitating the toner.

The developing sleeve 41, which is arranged so as to be opposed to the photoreceptor 20, is rotated by a driving device (not shown) in a direction indicated by an arrow. The developing sleeve 41 has magnets therein to form magnetic brush (i.e., chains of carrier particles (developer)) thereon. The magnets serve as a magnetic field forming member, and are fixedly arranged inside the developing sleeve 41.

The doctor blade 43 serving as a regulating member is integrally provided on one side of the developer container 42. In this example, the doctor blade 43 is arranged such that a predetermined gap is formed between the tip of the doctor blade and the circumferential surface of the developing sleeve 41.

A developing method using the developing device will be described. Specifically, the toner 21 is fed from the toner hopper 45 to the developer containing portion 46 by the toner agitator 48 and toner supplying member 49, and the toner 21 and the carrier 23 (i.e., the developer) are agitated by the developer agitators 47, resulting in impartment of frictional/separating charge to the toner. The developer is born on the surface of the developing sleeve 41, and then fed to the development region, in which the developing sleeve is opposed to the photoreceptor 20. In the development region, only the toner 21 is adhered to an electrostatic latent image formed on the photoreceptor 20, and thereby a toner image is formed on the surface of the photoreceptor 20.

Figure 2:
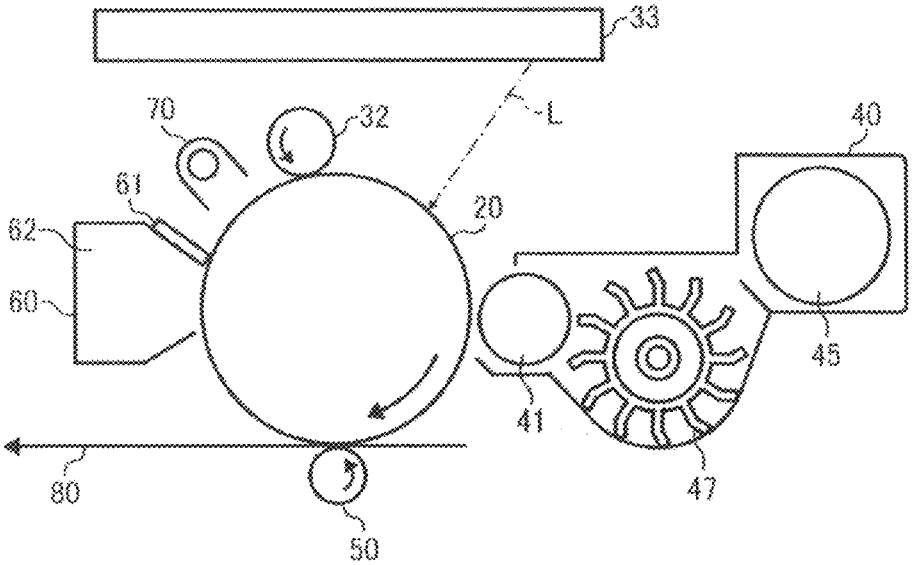
FIG. 2 is a schematic view illustrating an image forming apparatus for use in the image forming method.

FIG. 2 is a cross-sectional view of an example of the image forming apparatus of this disclosure, which includes the developing device mentioned above by reference to FIG. 10. Referring to FIG. 2, the image forming apparatus includes a charger 32 to charge a drum-shaped photoreceptor 20 serving as the image bearing member; an irradiator 33 to irradiate the charged photoreceptor with light L to form an electrostatic latent image on the photoreceptor 20; the developing device 40 to develop the electrostatic latent image with a developer including a toner and the carrier of this disclosure to form a toner image on the photoreceptor; a transferring device 50 to transfer the toner image onto a recording medium 80; a cleaner 60 to clean the surface of the photoreceptor 20, which includes a cleaning blade 61 and a collected toner container 62; and a discharging lamp 70 to reduce the residual charges present on the photoreceptor 20. These devices are arranged around the photoreceptor 20. In this image forming apparatus, the charger 32 and the irradiator 33 serve as an electrostatic latent image forming device.

In this image forming apparatus, the charger 32 is a short-range charger, and the gap between the surface of the photoreceptor 20 and the surface of the charging roller of the charger 32 is about 0.2 mm. In this regard, it is preferable that a DC voltage on which an AC voltage is superimposed is applied to the charging device 32 by a voltage applicator so that the photoreceptor 20 can be evenly charged by the charger. The image forming method and the developing method of the image forming apparatus are the following.

In this example of the image forming method, a nega-posi image forming operation is performed. Specifically, after charges remaining on the photoreceptor 20, which serves as the image bearing member and which is typified by an organic photoreceptor (OPC) having an organic photosensitive layer, are discharged by the discharging lamp 70 (i.e., discharging process), the surface of the photoreceptor 20 is negatively charged by the charger 32 such as charging rollers and charging wires (i.e., charging process). Next, laser light emitted by the irradiator 33 irradiates the charged photoreceptor 20 to form an electrostatic latent image thereon (i.e., electrostatic latent image forming process or irradiating process). In this regard, the absolute value of the potential of an irradiated portion of the photoreceptor 20 is lower than that of a non-irradiated portion of the photoreceptor.

Laser light emitted by a laser diode of the irradiator 33 is reflected by a polygon mirror, which is rotated at a high speed, to scan the surface of the photoreceptor 20 in a direction (i.e., main scanning direction) parallel to the rotation axis of the photoreceptor, resulting in formation of an electrostatic latent image on the photoreceptor. The thus formed electrostatic latent image is developed with the developer (including the toner and a carrier) on the developing sleeve 41, resulting in formation of a toner image on the photoreceptor 20. In this developing process, a proper DC voltage, on which an AC voltage is optionally superimposed and whose voltage falls between the potential of the irradiated portion of the photoreceptor 20 and the potential of the non-irradiated portion thereof, is applied as a development bias to the developing sleeve 41 by a voltage applicator.

Meanwhile, the recording medium 80 such as paper sheets is fed by a feeding device. The thus fed recording material 80 is timely fed by a pair of registration rollers to a transfer nip formed between the photoreceptor 20 and the transferring device 50 so that the toner image on the photoreceptor 20 is transferred onto a proper position of the recording medium 80 in the transfer region. In this regard, it is preferable that a voltage having a polarity opposite to that of the charge of the toner 21 is applied as a transfer bias to the transferring device 50. The recording medium 80 bearing the toner image thereon is then separated from the photoreceptor 20. Thus, a toner image is formed on the recording medium 80.

Residual toner particles remaining on the photoreceptor 20 even after the transfer process are removed therefrom by the cleaning blade 61 of the cleaner 60 (i.e., cleaning process).

The thus collected toner particles are stored in the collected toner container 62. The collected toner particles may be fed by a toner recycling device to the developing device or the toner hopper 45 to be reused.

The recording medium 80 bearing the toner image thereon is then fed to a fixing device to fix the toner image on the recording medium. In this regard, the image forming apparatus illustrated in FIG. 2 can have multiple developing devices so that multiple color toner images are sequentially formed on the photoreceptor 20, and the toner images are sequentially transferred onto the recording medium 80 optionally via an intermediate transfer medium to form a combined color toner image on the recording medium 80. The combined color toner image is then fixed by a fixing device.

Figure 3:
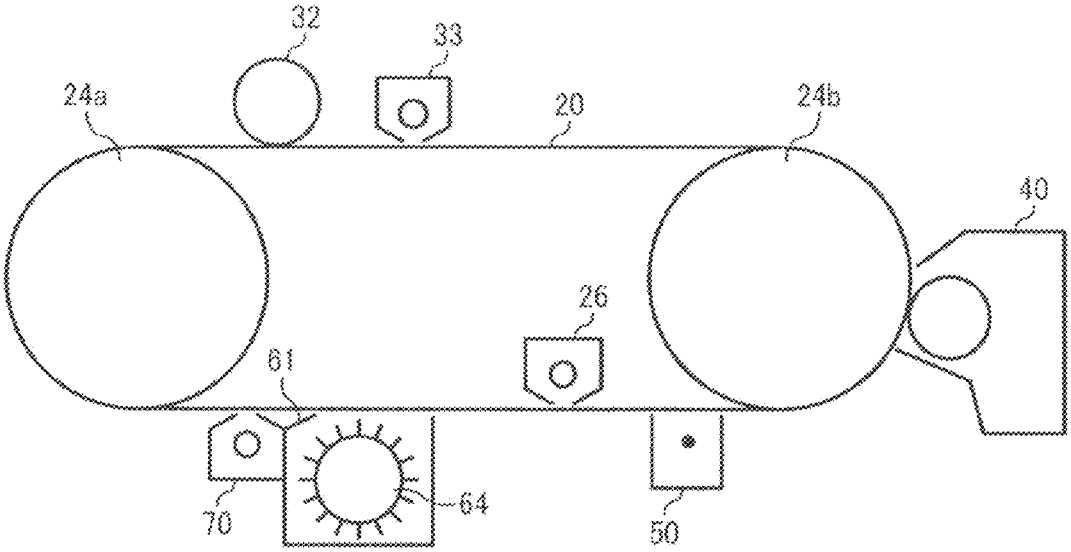
FIG. 3 is a schematic view illustrating another image forming apparatus for use in the image forming method.

FIG. 3 illustrates another example of the image forming apparatus of this disclosure. In the image forming apparatus, the photoreceptor 20 is an endless-belt-shaped photoreceptor having configuration such that at least a photosensitive layer is formed on an electroconductive substrate. The photoreceptor belt 20 is driven so as to be rotated by driving rollers **24*a*** and 24*b*. Similarly to the image forming apparatus illustrated in FIG. 2, the photoreceptor belt 20 is charged by the charger 32, and then exposed to light emitted by the irradiator 33, resulting in formation of an electrostatic latent image on the photoreceptor belt 20. The electrostatic latent image is developed by the developing device 40 to form a toner image on the photoreceptor belt 20, and the toner image is transferred onto a recording medium by a charger 50 serving as a transferring device. The photoreceptor belt 20 is then subjected to a pre-cleaning irradiating process using a light source 26; a cleaning process using a cleaner including the cleaning blade 61 and a cleaning brush 64; and a discharging process using the discharging lamp 70. In the image forming apparatus illustrated in FIG. 3, the pre-cleaning irradiation process is performed from the backside (i.e., substrate side) of the photoreceptor belt 20. In this regard, the substrate of the photoreceptor belt 20 is transparent so that light used for the pre-cleaning light irradiation process reaches the photosensitive layer of the photoreceptor belt 20.

Figure 4:
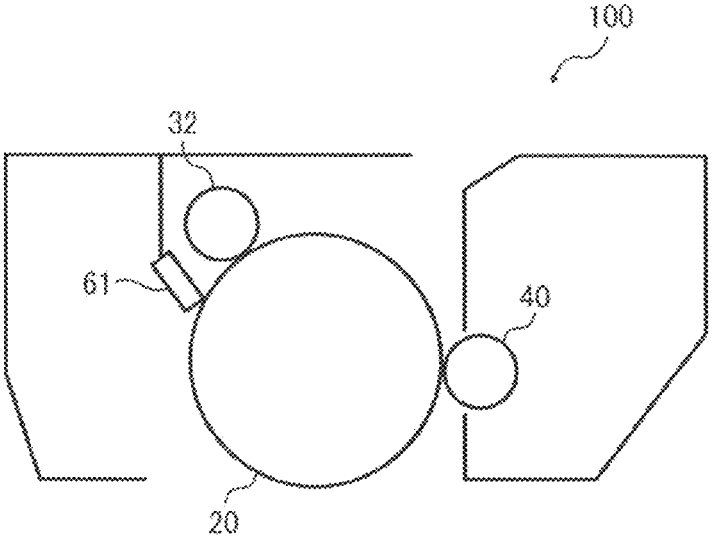
FIG. 4 is a schematic view illustrating a process cartridge according to an embodiment.

FIG. 4 illustrates an example of the process cartridge of this disclosure. Referring to FIG. 4, a process cartridge 100 uses the developer including a toner and the carrier of this disclosure, and includes the photoreceptor 20 serving as an image bearing member, a brush-form contact charger 32 to charge the photoreceptor, the developing device 40 to develop an electrostatic latent image formed on the photoreceptor 20 using a developer including a toner and the carrier of this disclosure, and the cleaning blade 61 serving as a cleaner to clean the surface of the photoreceptor. The photoreceptor 20, the charger 32, the developing device 40 and the cleaning blade 61 are integrated as a unit so that the process cartridge can be detachably attached to an image forming apparatus.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Core 1

Initially, $MnCO_3$, $Mg(OH)_2$, and $Fe_2O_3$ were mixed to prepare a powder mixture.

The powder mixture was calcined for 3 hours at 900° C. in the atmosphere. The calcined material was cooled and pulverized to prepare a powder having a particle diameter of about 3 μm. The powder was mixed with water and a 1% by weight aqueous solution of a dispersant to prepare a slurry. The slurry was fed to a spray drier to prepare particles of the mixture, which have an average particle diameter of about 40 μm. The thus prepared particles were fed to a baking furnace to be calcined for 5 hours at 1220° C. in a nitrogen atmosphere.

The calcined material was disintegrated by a disintegrator, followed by filtering to prepare a spherical ferrite (core 1), which has a volume average particle diameter of about 35 μm.

As a result of the componential analysis of the core 1, it was found that the contents of MnO, MgO and $Fe_2O_3$ are 46.2% by mole, 0.7% by mole, and 53% by mole, respectively. In addition, as a result of the observation of cross section of the core 1, it was found that the SF2 is 147, and the domain diameter is 3.5 μm.

Preparation of Core 2

Similarly to the method used for preparing the core 1, the powder mixture was calcined and pulverized to prepare a powder having a particle diameter of about 1 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 5 hours at 1300° C. in a nitrogen atmosphere.

The calcined material was disintegrated by a disintegrator, followed by filtering to prepare a spherical ferrite (core 2), which has a volume average particle diameter of about 35 μm.

As a result of the observation of cross section of the core 2, it was found that the SF2 of the core is 123, and the domain diameter thereof is 8.6 μm.

Preparation of Core 3

Similarly to the method used for preparing the core 2, the powder mixture was calcined and pulverized to prepare a powder having a particle diameter of about 1 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 5 hours at 1320° C. in a nitrogen atmosphere.

The calcined material was disintegrated by a disintegrator, followed by filtering to prepare a spherical ferrite (core 3), which has a volume average particle diameter of about 35 μm.

As a result of the observation of cross section of the core 3, it was found that the SF2 of the core is 119, and the domain diameter thereof is 9.5 μm.

Preparation of Core 4

Initially, $MnCO_3$, $Mg(OH)_2$, $Fe_2O_3$, and $SrCO_3$ were mixed to prepare a powder mixture.

The powder mixture was calcined for 1 hour at 850° C. in the atmosphere. The calcined material was cooled and pulverized to prepare a powder having a particle diameter of about 3 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 4 hours at 1120° C. in a nitrogen atmosphere.

The calcined material was disintegrated by a disintegrator, followed by filtering to prepare a spherical ferrite (core 4), which has a volume average particle diameter of about 35 μm.

As a result of the componential analysis of the core 4, it was found that the contents of MnO, MgO, $Fe_2O_3$ and $SrCO_3$ are 40.0% by mole, 10.0% by mole, 50% by mole, and 0.4% by mole, respectively. In addition, as a result of the observation of cross section of the core 4, it was found that the SF2 is 159, and the domain diameter is 1.8 μm.

Preparation of Core 5

Similarly to the method used for preparing the core 4, the powder mixture was calcined and pulverized to prepare a powder having a particle diameter of about 3 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 4 hours at 1150° C. in a nitrogen atmosphere.

The calcined material was disintegrated by a disintegrator, followed by filtering to prepare a spherical ferrite (core 5), which has a volume average particle diameter of about 35 μm.

As a result of the observation of cross section of the core 5, it was found that the SF2 of the core is 132, and the domain diameter thereof is 4.6 μm.

Preparation of Core 6

Similarly to the method used for preparing the core 4, the powder mixture was calcined and pulverized to prepare a powder having a particle diameter of about 3 μm. The powder was mixed with water and a 1% by weight aqueous solution of a dispersant to prepare a slurry. The slurry was fed to a spray drier to prepare particles of the mixture, which have an average particle diameter of about 40 μm. The particles were fed to a baking furnace to be calcined for 4 hours at 1080° C. in a nitrogen atmosphere.

The calcined material was disintegrated by a disintegrator, followed by filtering to prepare a spherical ferrite (core 6), which has a volume average particle diameter of about 35 μm.

As a result of the observation of cross section of the core 6, it was found that the SF2 of the core is 163, and the domain diameter thereof is 0.9 μm.

Preparation of Particulate Electroconductive Material 1

Initially, 100 g of an aluminum oxide (AKP-30 from Sumitomo Chemical Co., Ltd.) was dispersed in 1 liter of water to prepare a suspension, and the suspension was heated to 70° C. Next, a solution prepared by dissolving 11.6 g of stannic chloride in 1 liter of 2N hydrochloric acid, and 12% by weight ammonia water were dropped into the suspension, over 40 minutes so that the pH of the suspension falls in a range of from 7 to 8. In addition, a solution prepared by dissolving 36.7 g of indium chloride, and 5.4 g of stannic chloride in 0.45 liter of 2N hydrochloric acid, and 12% by weight ammonia water were dropped into the suspension over one hour so that the pH of the suspension falls in a range of from 7 to 8.

The suspension was then filtered and the resultant cake was washed, followed by drying at 110° C. The thus obtained powder was heated for 4 hours at 500° C. in a nitrogen atmosphere. Thus, a particulate electroconductive material 1, which has an average particle diameter of 300 nm and a volume resistivity of 5 Ω·cm, was prepared.

Preparation of Particulate Electroconductive Material 2

Initially, 100 g of an aluminum oxide (AKP-30 from Sumitomo Chemical Co., Ltd.) was dispersed in 1 liter of water to prepare a suspension, and the suspension was heated to 70° C. Next, a solution prepared by dissolving 200 g of stannic chloride, and 6 g of phosphorus pentaoxide in 1 liter of 2N hydrochloric acid, and 12% by weight ammonia water were dropped into the suspension over 4 hours so that the pH of the suspension falls in a range of from 7 to 8.

The suspension was then filtered and the resultant cake was washed, followed by drying at 110° C. The thus obtained powder was heated for 4 hours at 500° C. in a nitrogen atmosphere. Thus, a particulate electroconductive material 2, which has an average particle diameter of 540 nm and a volume resistivity of 8 Ω·cm, was prepared.

Preparation of Particulate Electroconductive Material 3

Initially, 100 g of an aluminum oxide (AKP-20 from Sumitomo Chemical Co., Ltd.) was dispersed in 1 liter of water to prepare a suspension, and the suspension was heated to 70° C. Next, a solution prepared by dissolving 250 g of stannic chloride, and 7.5 g of phosphorus pentaoxide in 1.5 liters of 2N hydrochloric acid, and 12% by weight ammonia water were dropped into the suspension over 5 hours so that the pH of the suspension falls in a range of from 7 to 8.

The suspension was then filtered and the resultant cake was washed, followed by drying at 110° C. The thus obtained powder was heated for 4 hours at 500° C. in a nitrogen atmosphere. Thus, a particulate electroconductive material 3, which has an average particle diameter of 760 nm and a volume resistivity of 9 Ω·cm, was prepared.

Preparation of Particulate Electroconductive Material 4

Initially, 100 g of an aluminum oxide (A-43-M from Showa Denko K.K.) was dispersed in 1 liter of water to prepare a suspension, and the suspension was heated to 70° C. Next, a solution prepared by dissolving 600 g of stannic chloride, and 18 g of phosphorus pentaoxide in 1.5 liters of 2N hydrochloric acid, and 12% by weight ammonia water were dropped into the suspension over 12 hours so that the pH of the suspension falls in a range of from 7 to 8.

The suspension was then filtered and the resultant cake was washed, followed by drying at 110° C. The thus obtained powder was heated for 4 hours at 500° C. in a nitrogen atmosphere. Thus, a particulate electroconductive material 4, which has an average particle diameter of 1200 nm and a volume resistivity of 2 Ω·cm, was prepared.

Synthesis of Resin 1

Three hundreds (300) grams of toluene was fed into a flask equipped with an agitator, and was heated to 90° C. under a nitrogen gas flow. Next, a mixture of 84.4 g (200 mmol) of 3-methacryloxypropyltris(trimethylsiloxy)silane ($CH_2{=}C(CH_3)—COO—C_3H_6—Si(OSi(CH_3)_3)_3$, SILAPLANE TM-0701T from CHISSO CORPORATION), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was dropped into the flask over one hour.

After dropping the mixture, a solution prepared by dissolving 0.06 g (0.3 mmol) of 2,2'-azobis-2-methylbutyronitrile in 15 g of toluene was fed into the flask (i.e., the total added amount of 2,2'-azobis-2-methylbutyronitrile is 0.64 g (3.3 mmol)), and the mixture was agitated for 3 hours at a temperature of from 90 to 100° C. to perform radical copolymerization. Thus, a methacrylic copolymer (i.e., resin 1), which has a weight average molecular weight of 33,000, was prepared.

The solution of the resin 1 was diluted with toluene so as to have a solid content of 25% by weight. It was confirmed that the resin solution has a viscosity of 8.8 $mm^2/s$, and a specific gravity of 0.91.

Synthesis of Resin 2

The procedure for preparation of the resin 1 was repeated except that 3-methacryloxypropylmethyldiethoxysilane was replaced with 37.2 g (150 mmol) 3-methacryloxypropyltrimethoxysilane to prepare a methacrylic copolymer (resin 2), which has a weight average molecular weight of 34,000.

The solution of the resin 2 was diluted with toluene so as to have a solid content of 25% by weight. It was confirmed that the resin solution has a viscosity of 8.7 $mm^2/s$, and a specific gravity of 0.91.

Preparation of Carriers

Examples 1-15 and Comparative Examples 1-7

Details of the materials used for the below-mentioned Examples 1-15 and Comparative Examples 1-7 are as follows.

Methylsilicone resin: 25% solution of a methylsilicone resin which is prepared by using a di- or tri-functional monomer and which has a weight average molecular weight of 15,000 (RSR-213 from Dow Corning Toray Silicone Co., Ltd.)

Titanium catalyst: titanium diisopropoxy bis(ethyl acetoacetate) (TC-750 from Matsumoto Fine Chemical Co., Ltd.).

Silane coupling agent: 3-(2-aminoethyl)aminopropyltrimethoxysilane, SH6020 from Dow Corning Toray Silicone Co., Ltd.

Example 1

The following components were mixed.

| | |
|---|---|
| Methylsilicone resin | 110 parts |
| Particulate electroconductive material 2 prepared above (serving as a filler) | 50 parts |
| Titanium catalyst | 7 parts |
| Silane coupling agent | 1 part |

The mixture was diluted with toluene to prepare a cover layer coating liquid having a solid content of 10% by weight.

Next, 1,000 parts of the core 1 was coated with the cover layer coating liquid and then dried using a fluidized bed type coating machine in which the temperature of the fluidized bed is controlled at 70° C. The coated carrier was heated for 2 hours at 180° C. to prepare a carrier A.

Example 2

The procedure for preparation of the carrier A was repeated except that the following components were used.

| | |
|---|---|
| Methylsilicone resin | 120 parts |
| Particulate electroconductive material 3 prepared above (serving as a filler) | 45 parts |
| Titanium catalyst | 7 parts |
| Silane coupling agent | 1 part |

Thus, a carrier B was prepared.

Example 3

The procedure for preparation of the carrier A was repeated except that the following components were used.

| | |
|---|---|
| Methylsilicone resin | 30 parts |
| Resin 1 prepared above | 30 parts |
| Barium sulfate coated with $SnO_2$ (serving as a filler) (PASSTRAN 4310 from Mitsui Mining & Smelting Co., Ltd. having an average particle diameter of 150 nm) | 33 parts |
| Titanium catalyst | 4 parts |
| Silane coupling agent | 0.6 parts |

Thus, a carrier C was prepared.

Example 4

The procedure for preparation of the carrier A was repeated except that the following components were used.

| | |
|---|---|
| Methylsilicone resin | 64 parts |
| Resin 2 prepared above | 16 parts |

-continued

| | |
|---|---|
| Tin oxide powder (serving as a filler) (S2000 from Mitsubishi Materials Electronic Chemicals Co., Ltd. having an average particle diameter of 30 nm) | 20 parts |
| Titanium catalyst | 5 parts |
| Silane coupling agent | 0.8 parts |

Thus, a carrier D was prepared.

Example 5

The procedure for preparation of the carrier A was repeated except that the following components were used.

| | |
|---|---|
| Methylsilicone resin | 42 parts |
| Resin 2 prepared above | 2 parts |
| Particulate electroconductive material 1 prepared above (serving as a filler) | 15 parts |
| Titanium catalyst | 3 parts |
| Silane coupling agent | 0.6 parts |

Thus, a carrier E was prepared.

Example 6

The procedure for preparation of the carrier A was repeated except that the following components were used and the core 1 was replaced with the core 2.

| | |
|---|---|
| Methylsilicone resin | 30 parts |
| Resin 1 prepared above | 50 parts |
| Particulate electroconductive material 1 prepared above (serving as a filler) | 60 parts |
| Titanium catalyst | 5 parts |
| Silane coupling agent | 0.8 parts |

Thus, a carrier F was prepared.

Example 7

The procedure for preparation of the carrier A was repeated except that the following components were used, and the core 1 was replaced with the core 2.

| | |
|---|---|
| Methylsilicone resin | 60 parts |
| Particulate electroconductive material 3 prepared above (serving as a filler) | 25 parts |
| Titanium catalyst | 4 parts |
| Silane coupling agent | 0.6 parts |

Thus, a carrier G was prepared.

Example 8

The procedure for preparation of the carrier A was repeated except that the following components were used, and the core 1 was replaced with the core 2.

| | |
|---|---|
| Resin 1 prepared above | 110 parts |
| Tin oxide powder (serving as a filler) (S2000 from Mitsubishi Materials Electronic Chemicals Co., Ltd. having an average particle diameter of 30 nm) | 40 parts |
| Titanium catalyst | 7 parts |
| Silane coupling agent | 1 part |

Thus, a carrier H was prepared.

Example 9

The procedure for preparation of the carrier A was repeated except that the following components were used, and the core 1 was replaced with the core 4.

| | |
|---|---|
| Methylsilicone resin | 110 parts |
| Particulate electroconductive material 4 prepared above (serving as a filler) | 50 parts |
| Titanium catalyst | 7 parts |
| Silane coupling agent | 1 part |

Thus, a carrier I was prepared.

Example 10

The procedure for preparation of the carrier A was repeated except that the following components were used, and the core 1 was replaced with the core 4.

| | |
|---|---|
| Methylsilicone resin | 12 parts |
| Resin 1 prepared above | 48 parts |
| Barium sulfate coated with $SnO_2$ (serving as a filler) (PASSTRAN 4310 from Mitsui Mining & Smelting Co., Ltd. having an average particle diameter of 150 nm) | 15 parts |
| Titanium catalyst | 4 parts |
| Silane coupling agent | 0.6 parts |

Thus, a carrier J was prepared.

Example 11

The procedure for preparation of the carrier A was repeated except that the following components were used, and the core 1 was replaced with the core 4.

| | |
|---|---|
| Methylsilicone resin | 30 parts |
| Resin 1 prepared above | 30 parts |
| Particulate electroconductive material 1 prepared above (serving as a filler) | 16 parts |
| Titanium catalyst | 4 parts |
| Silane coupling agent | 0.6 parts |

Thus, a carrier K was prepared.

Example 12

The procedure for preparation of the carrier A was repeated except that the following components were used, and the core 1 was replaced with the core 5.

| | |
|---|---|
| Methylsilicone resin | 35 parts |
| Resin 2 prepared above | 9 parts |
| Particulate electroconductive material 1 prepared above (serving as a filler) | 10 parts |
| Titanium catalyst | 3 parts |
| Silane coupling agent | 0.3 parts |

Thus, a carrier L was prepared.

Example 13

The procedure for preparation of the carrier A was repeated except that the following components were used, and the core 1 was replaced with the core 5.

| | |
|---|---|
| Methylsilicone resin | 35 parts |
| Particulate electroconductive material 2 prepared above (serving as a filler) | 10 parts |
| Titanium catalyst | 2 parts |
| Silane coupling agent | 0.2 parts |

Thus, a carrier M was prepared.

Example 14

The procedure for preparation of the carrier A was repeated except that the following components were used, and the core 1 was replaced with the core 5.

| | |
|---|---|
| Methylsilicone resin | 100 parts |
| Resin 1 prepared above | 100 parts |
| Tin oxide powder (serving as a filler) (S2000 from Mitsubishi Materials Electronic Chemicals Co., Ltd. having an average particle diameter of 30 nm) | 60 parts |
| Titanium catalyst | 12 parts |
| Silane coupling agent | 2 parts |

Thus, a carrier N was prepared.

Example 15

The procedure for preparation of the carrier A was repeated except that the following components were used, and the core 1 was replaced with the core 2.

| | |
|---|---|
| Methylsilicone resin | 20 parts |
| Particulate electroconductive material 1 prepared above (serving as a filler) | 10 parts |
| Titanium catalyst | 1 part |
| Silane coupling agent | 0.2 parts |

Thus, a carrier O was prepared.

Comparative Example 1

The procedure for preparation of the carrier A was repeated except that the following components were used, and the core 1 was replaced with the core 3.

| | |
|---|---|
| Methylsilicone resin | 110 parts |
| Particulate electroconductive material 3 prepared above (serving as a filler) | 34 parts |
| Titanium catalyst | 7 parts |
| Silane coupling agent | 1 part |

Thus, a carrier P was prepared.

Comparative Example 2

The procedure for preparation of the carrier A was repeated except that the following components were used, and the core 1 was replaced with the core 4.

| | |
|---|---|
| Methylsilicone resin | 35 parts |
| Resin 1 prepared above | 10 parts |
| Tin oxide powder (serving as a filler) (S2000 from Mitsubishi Materials Electronic Chemicals Co., Ltd. having an average particle diameter of 30 nm) | 10 parts |

-continued

| | |
|---|---|
| Titanium catalyst | 3 parts |
| Silane coupling agent | 0.6 parts |

Thus, a carrier Q was prepared.

Comparative Example 3

The procedure for preparation of the carrier A was repeated except that the following components were used, and the core 1 was replaced with the core 2.

| | |
|---|---|
| Methylsilicone resin | 100 parts |
| Carbon black (serving as a filler) (MONARCH 1100 from Cabot Corporation having an average particle diameter of 14 nm) | 5 parts |
| Titanium catalyst | 6 parts |
| Silane coupling agent | 1 part |

Thus, a carrier R was prepared.

Comparative Example 4

The procedure for preparation of the carrier A was repeated except that the following components were used, and the core 1 was replaced with the core 6.

| | |
|---|---|
| Methylsilicone resin | 20 parts |
| Resin 2 prepared above | 30 parts |
| Particulate electroconductive material 4 prepared above (serving as a filler) | 15 parts |
| Titanium catalyst | 3 parts |
| Silane coupling agent | 0.6 parts |

Thus, a carrier S was prepared.

Comparative Example 5

The procedure for preparation of the carrier A was repeated except that the following components were used, and the core 1 was replaced with the core 6.

| | |
|---|---|
| Methylsilicone resin | 25 parts |
| Particulate electroconductive material 3 prepared above (serving as a filler) | 10 parts |
| Titanium catalyst | 2 parts |
| Silane coupling agent | 0.8 parts |

Thus, a carrier T was prepared.

Comparative Example 6

The procedure for preparation of the carrier A was repeated except that the following components were used, and the core 1 was replaced with the core 6.

| | |
|---|---|
| Methylsilicone resin | 100 parts |
| Resin 1 prepared above | 100 parts |
| Particulate electroconductive material 2 prepared above (serving as a filler) | 60 parts |
| Titanium catalyst | 12 parts |
| Silane coupling agent | 2 parts |

Thus, a carrier U was prepared.

Comparative Example 7

The procedure for preparation of the carrier A was repeated except that the following components were used, and the core 1 was replaced with the core 4.

| | |
|---|---|
| Methylsilicone resin | 80 parts |
| Particulate electroconductive material 1 prepared above (serving as a filler) | 70 parts |
| Titanium catalyst | 5 parts |
| Silane coupling agent | 0.8 parts |

Thus, a carrier V was prepared.

Preparation of Developers

Examples 16-30 and Comparative Examples 8-14

The following components were mixed.

| | |
|---|---|
| Carrier (A-V) prepared above | 930 parts |
| Cyan toner (Cyan toner used for an image forming apparatus, RICOH PRO C901 from Ricoh Co., Ltd. | 70 parts |

The mixture was agitated for 5 minutes using a TURBULA MIXER mixer rotated at 81 rpm to prepare developers of Examples 16-30 and Comparative Examples 8-14. In addition, the procedure for preparation of the developers was repeated except that the weight ratio (C/T) of the carrier to the toner was changed to from 930/70 to 100/900 to prepare supplementary developers of the developers of Examples 16-30 and Comparative Examples 8-14.

The developers of Examples 16-30 and Comparative Examples 8-14 were evaluated with respect to the following properties.

1. Ghost Image

Figure 7A:
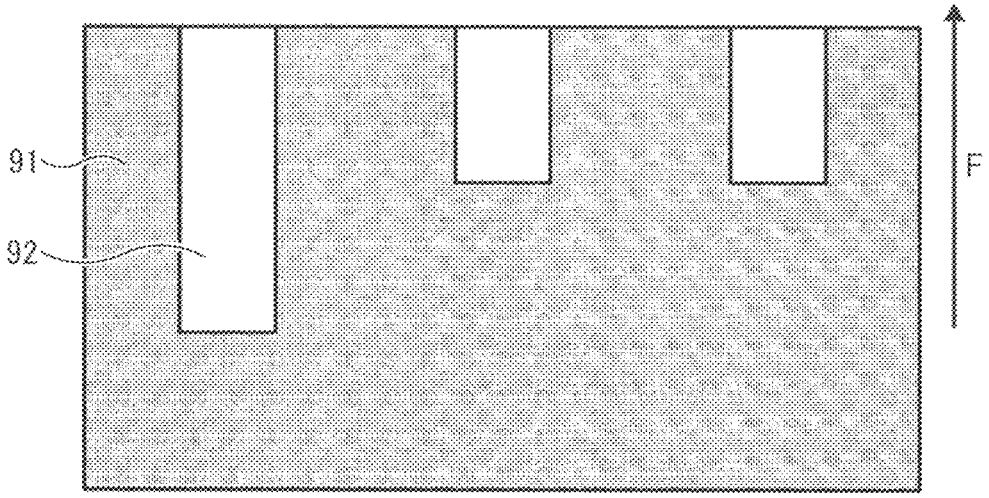
FIGS. 7A and 7B respectively illustrate a normal vertical stripe image and an image having ghost images.
Figure 7B:
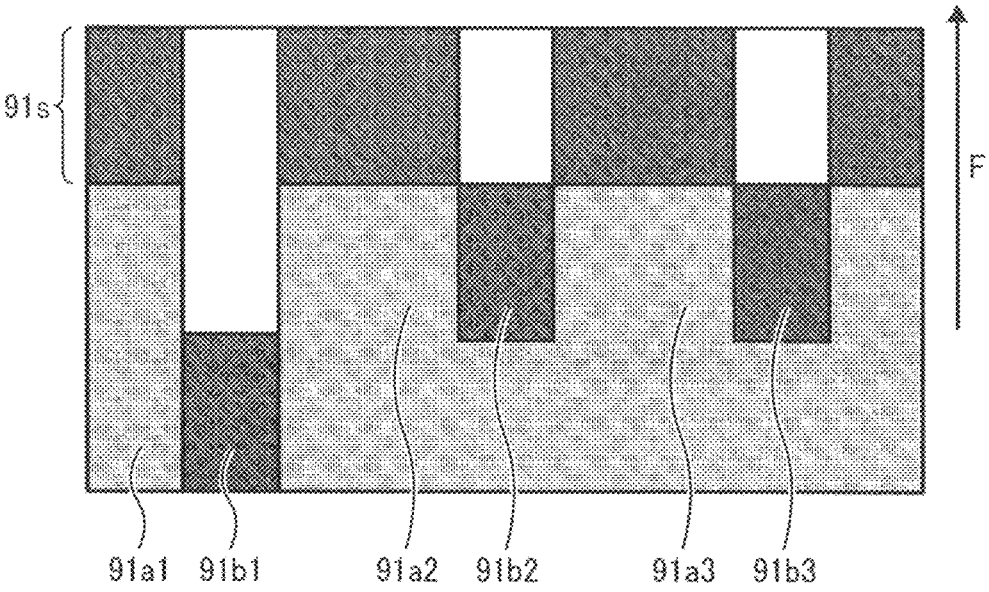

A developer and the corresponding supplementary developer were set in a digital full color printer, RICOH PRO C901 from Ricoh Co., ltd., and a running test in which 100,000 copies of a character image chart in which character images each having a size of 2 mm×2 mm are printed in an image area proportion of 8% are produced while supplying the supplementary developer was performed. Next, a copy of a vertical stripe image chart, which is illustrated in FIG. 7A and which includes an image area 91 and a non-image area 92, was produced by the image forming apparatus. An image having a ghost image is illustrated in FIG. 7B. In FIG. 7B, numerals 91*s*, 91*b*1, 91*b*2 and 91*b*3 denote an image portion which is a front edge portion of a solid image and whose length in the vertical direction is equal to the peripheral length of the development sleeve (i.e., the image portion is developed during the development sleeve is rotated one revolution). Numerals 91*a*1, 91*a*2 and 91*a*3 denote an image portion which is developed after the front edge portion (the portion 91*s*) of the solid image is developed. The image density of the image portion 91*a*1 and the image density of an image portion 91*b*1 were measured to determine the image density difference ΔID. In addition, the image density difference between the image density of the image portion 91*a*2 and the image density of the image portion 91*b*2, and the image density difference between the image density of the image portion 91*a*3 and the image density of the image portion 91*b*3 were determined. The three data of the image density difference ΔID were averaged to determine the image density difference ΔID of the image illustrated in FIG. 7B. The ghost image property of the developer was graded as follows.

◎: The image density difference is not greater than 0.01. (Excellent)

○: The image density difference is greater than 0.01 and not greater than 0.03. (Good)

Δ: The image density difference is greater than 0.03 and not greater than 0.06. (Usable)

X: The image density difference is greater than 0.06. (Unusable)

2. Change of Electric Resistance of Carrier after 100,000-Copy Running Test

The static resistance of each of the carrier in a new developer and the developer after the 100,000-copy running test mentioned above was measured. Specifically, by using a device for measuring the charge quantity of a developer, which is illustrated in FIG. 6 and which uses a screen with 795-mesh for a blow-off cage 15, toner in a developer was removed from the developer to obtain the carrier of the developer, and the electric resistance of the carrier was measured with the cell illustrated in FIG. 5. Similarly, the electric resistance of the carrier in the developer after the 100,000-copy running test was also measured to determine the electric resistance difference Δ Log R.

In the device illustrated in FIG. 6, the developer including a carrier C and a toner T was set in the blow-off cage 15. A compressed gas G was fed to the blow-off cage to blow the toner T off the carrier C. The electric resistance of the carrier remaining in the blow-off cage 15 was measured using a cell 11 illustrated in FIG. 5. Numeral 16 in FIG. 6 denotes a volt meter, which was not used for this evaluation.

Figure 5:
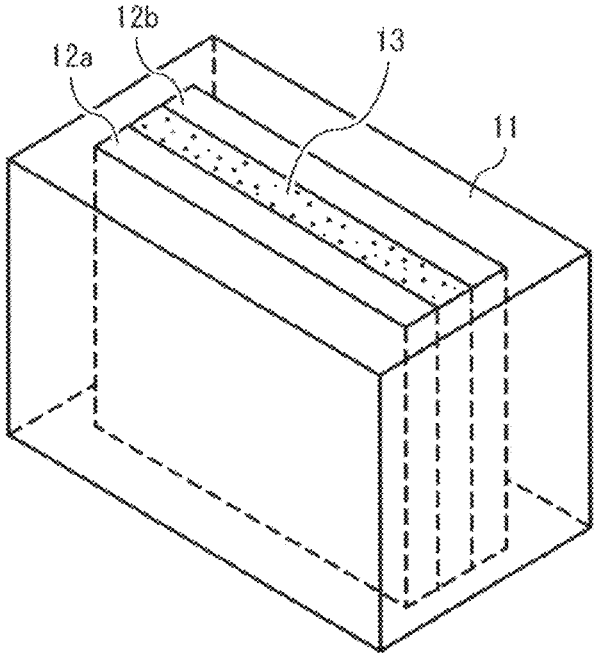
FIG. 5 is a schematic perspective view illustrating a resistance measuring cell for use in measuring the electric resistance of a carrier.
Figure 6:
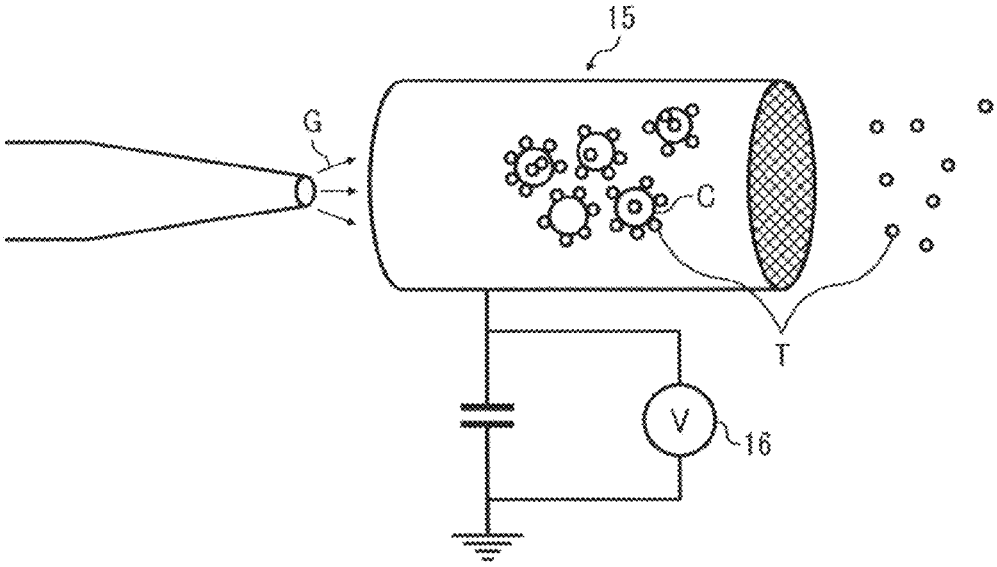
FIG. 6 is a schematic view illustrating a device for measuring the charge quantity of a developer.

In the cell 11 illustrated in FIG. 5, numerals 12*a* and 12*b* denote a pair of electrodes. A sample 13 (i.e., carrier in this case) was fed into the gap between the pair of electrodes 12*a* and 12*b* of the cell 11. A voltage was applied to the electrodes while detecting the current flowing the electrodes to determine the electric resistance R of the sample (carrier) 13. In this evaluation, a logarithmic value Log R of the electric resistance R was used.

The property of electric resistance change of the carrier was graded as follows.

◎: The electric resistance difference Δ Log R is not greater than 0.5. (Excellent)

○: The electric resistance difference Δ Log R is greater than 0.5 and not greater than 1. (Good)

Δ: The electric resistance difference Δ Log R is greater than 1 and not greater than 2. (Usable)

X: The electric resistance difference Δ Log R is greater than 2. (Unusable)

3. Amount of Spent Toner on Carrier

Before and after the 100,000-copy running test mentioned above, the developer was subjected to an extraction treatment using methyl ethyl ketone to determine the difference in amount of the methyl ethyl ketone-soluble components (i.e., amount of spent toner) present on the carrier. In this regard, the amount of spent toner was represented by the weight ratio (%) of the spent toner to the carrier.

The spent toner amount of the carrier was graded as follows.

◎: The spent toner amount is less than 0.03%. (Excellent)

○: The spent toner amount is not less than 0.03% and less than 0.07%. (Good)

Δ: The spent toner amount is not less than 0.07% and less than 0.15%. (Usable)

X: The spent toner amount is not less than 0.15%. (Unusable)

The properties of the carriers A-V (carriers of Examples 1-15 and Comparative Examples 1-7) prepared above are shown in Table 1-1 below, and the evaluation results of the developers of Examples 16-30 and Comparative Examples 8-14 are shown in Table 1-2 below.

TABLE 1-1

| Ex. or Comp. Ex. (carrier) | SF2 of core | Area ratio of filler (%) | Domain diameter of core (μm) | Number average particle diameter of filler (nm) | Domain diameter/filler diameter ratio | Core revealing rate (%) |
|---|---|---|---|---|---|---|
| Ex. 1 (A) | 147 | 58 | 3.5 | 540 | 1:0.154 | 2 |
| Ex. 2 (B) | 147 | 48 | 3.5 | 760 | 1:0.217 | 2 |
| Ex. 3 (C) | 147 | 67 | 3.5 | 150 | 1:0.043 | 5 |
| Ex. 4 (D) | 147 | 34 | 3.5 | 30 | 1:0.009 | 4 |
| Ex. 5 (E) | 147 | 39 | 3.5 | 300 | 1:0.086 | 6 |
| Ex. 6 (F) | 123 | 83 | 8.6 | 300 | 1:0.035 | 2 |
| Ex. 7 (G) | 123 | 47 | 8.6 | 760 | 1:0.088 | 3 |
| Ex. 8 (H) | 123 | 43 | 8.6 | 30 | 1:0.0035 | ≤1 |
| Ex. 9 (I) | 159 | 55 | 1.8 | 1200 | 1:0.667 | 3 |
| Ex. 10 (J) | 159 | 33 | 1.8 | 150 | 1:0.083 | 6 |
| Ex. 11 (K) | 159 | 36 | 1.8 | 300 | 1:0.167 | 6 |
| Ex. 12 (L) | 132 | 31 | 4.6 | 300 | 1:0.065 | 6 |
| Ex. 13 (M) | 132 | 45 | 4.6 | 540 | 1:0.117 | 9 |
| Ex. 14 (N) | 132 | 36 | 4.6 | 30 | 1:0.007 | ≤1 |
| Ex. 15 (O) | 123 | 58 | 8.6 | 540 | 1:0.063 | 11 |
| Comp. Ex. 1 (P) | 119 | 38 | 9.5 | 760 | 1:0.080 | ≤1 |
| Comp. Ex. 2 (Q) | 159 | 28 | 1.8 | 30 | 1:0.017 | 8 |
| Comp. Ex. 3 (R) | 123 | 4 | 8.6 | 14 | 1:0.0025 | ≤1 |
| Comp. Ex. 4 (S) | 163 | 37 | 0.9 | 1200 | 1:1.333 | 10 |
| Comp. Ex. 5 (T) | 163 | 49 | 0.9 | 760 | 1:0.844 | 12 |
| Comp. Ex. 6 (U) | 163 | 38 | 0.9 | 540 | 1:0.600 | 1 |

TABLE 1-1-continued

| Ex. or Comp. Ex. (carrier) | SF2 of core | Area ratio of filler (%) | Domain diameter of core (μm) | Number average particle diameter of filler (nm) | Domain diameter/filler diameter ratio | Core revealing rate (%) |
|---|---|---|---|---|---|---|
| Comp. Ex. 7 (V) | 159 | 87 | 1.8 | 300 | 1:0.167 | 6 |

TABLE 1-2

| Ex. or Comp. Ex. (developer) | Carrier | Ghost image | Electric resistance change | Amount of spent toner |
|---|---|---|---|---|
| Ex. 16 | Ex. 1 (A) | ◎ | ◎ | ◎ |
| Ex. 17 | Ex. 2 (B) | ◎ | ◎ | ◎ |
| Ex. 18 | Ex. 3 (C) | ◎ | ◎ | ○ |
| Ex. 19 | Ex. 4 (D) | ◎ | ◎ | ◎ |
| Ex. 20 | Ex. 5 (E) | ◎ | ◎ | ◎ |
| Ex. 21 | Ex. 6 (F) | ○ | ◎ | ○ |
| Ex. 22 | Ex. 7 (G) | ○ | ◎ | ◎ |
| Ex. 23 | Ex. 8 (H) | ○ | ◎ | ◎ |
| Ex. 24 | Ex. 9 (I) | ◎ | ○ | ◎ |
| Ex. 25 | Ex. 10 (J) | ◎ | ○ | ◎ |
| Ex. 26 | Ex. 11 (K) | ◎ | ◎ | ◎ |
| Ex. 27 | Ex. 12 (L) | ◎ | ◎ | ◎ |
| Ex. 28 | Ex. 13 (M) | ◎ | ◎ | ◎ |
| Ex. 29 | Ex. 14 (N) | ◎ | ◎ | ◎ |
| Ex. 30 | Ex. 15 (O) | ◎ | ○ | ○ |
| Comp. Ex. 8 | Comp. Ex. 1 (P) | X | ○ | ○ |
| Comp. Ex. 9 | Comp. Ex. 2 (Q) | ◎ | Δ | ◎ |
| Comp. Ex. 10 | Comp. Ex. 3 (R) | ○ | X | ◎ |
| Comp. Ex. 11 | Comp. Ex. 4 (S) | ◎ | Δ | ○ |
| Comp. Ex. 12 | Comp. Ex. 5 (T) | ◎ | X | ○ |
| Comp. Ex. 13 | Comp. Ex. 6 (U) | ◎ | ○ | ○ |
| Comp. Ex. 14 | Comp. Ex. 7 (V) | ○ | Δ | X |

The developers of Examples 16-30 have advantages such that the image density difference ΔID in the evaluation of ghost image is small, the electric resistance difference Δ Log R is small, the amount of spent toner is small, and therefore variation of quality of images produced by the developers is little.

In contrast, the developer of Comparative Example 8 has large image density difference ΔID in the evaluation of ghost image. The developers of Comparative Examples 9-12 have a drawback such that the electric resistance largely decreases after the 100,000-copy running test, and therefore the amount of toner constituting line images decreases, and the image density increases after the running test. Namely, the image qualities largely change. In addition, in the developer of Comparative Example 11, many filler particles were released from the surface of the carrier in the running test. Further, the developer of Comparative Example 13 is of the usable level with respect to the ghost image property, the electric resistance change and the spent toner amount, but the developer causes the carrier adhesion problem in that carrier particles adhere to an electrostatic latent image on an image bearing member. The developer of Comparative Example 14 has drawbacks such that the spent toner amount is large, and the electric resistance of the carrier increases after the running test.

As mentioned above, the carrier of this disclosure has advantages such that ghost images are hardly formed by a developer including the carrier because the developer is not affected by the history of images previously formed on an image bearing member; the spent toner problem is hardly caused by the developer even when images with a high image area proportion are formed; and the resistance decreasing problem is hardly caused by the developer even when images with a low image area proportion are formed.

In addition, the carrier of this disclosure has an advantage such that the cover layer of the carrier has a good combination of hardness and toughness (i.e., a good combination of flexibility and elasticity), and therefore the cover layer has good abrasion resistance (i.e., good resistance to abrasion and peeling), resulting in prevention of variation of charge quantity of toner caused by the spent toner problem (i.e., resulting in stabilization of charge quantity of toner over a long period of time).

Additional modifications and variations of the present invention are possible in light of the above teachings. It is therefore to be understood that within the scope of the appended claims the invention may be practiced other than as specifically described herein.

What is claimed is:

1. A carrier, comprising:

a particulate magnetic core having an average domain diameter of from 1 μm to 10 μm; and a cover layer located on a surface of the particulate magnetic core and comprising a resin and a filler, wherein:

when determined from observation of cross-section of the carrier, a shape factor SF2 of the carrier is from 120 to 160;

a ratio of the average domain diameter of the particulate magnetic core to a number average particle diameter of the filler is from 1:1 to 1:0.003;

the number average particle diameter of the filler, which is determined from the cross-section of the carrier, is from 540 nm to 800 nm;

the carrier has a core revealing rate, which is defined as a ratio of length of an uncovered surface of the magnetic core to perimeter of the magnetic core, and which is determined from the cross-section of the carrier, of from 2.5% to 9%; and an area ratio of the filler in the cover layer is from 30 to 85%, and wherein:

the resin comprises a crosslinked material prepared by hydrolyzing a copolymer having the following formula (1) to generate a silanol group and then condensing a resulting hydrolyzed resin:

(1)

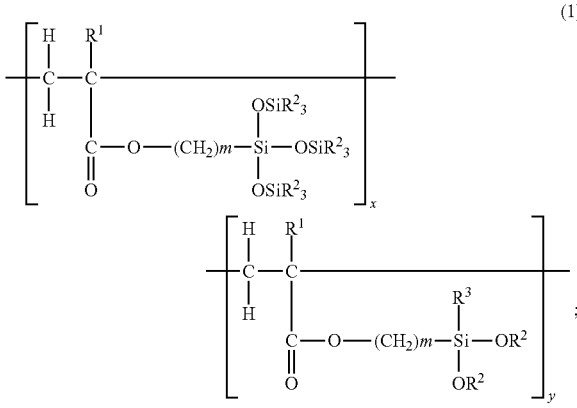

R[1] independently represents a hydrogen atom or a methyl group;

R[2] independently represents an alkyl group having 1 to 4 carbon atoms;

R[3] independently represents an alkyl group having 1 to 8 carbon atoms or an alkoxyl group having 1 to 4 carbon atoms;

m independently represents an integer of from 1 to 8; and

X and Y independently represent molar ratios of their corresponding repeating units, wherein each of X and Y is from 10% by mole to 90% by mole.

2. The carrier according to claim 1, wherein the filler in the cover layer has a number average particle diameter, which is determined from the cross-section of the carrier, of from 540 nm to 760 nm.

3. The carrier according to claim 1, wherein:

m represents the integer 3; and the copolymer further comprises an additional acrylate-containing repeating unit.

4. A two-component developer, comprising:

a carrier according to claim 1; and a toner.

5. An image forming method, comprising:

forming an electrostatic latent image on a surface of an image bearing member;

developing the electrostatic latent image with the developer according to claim 4 to form a toner image on the surface of the image bearing member;

transferring the toner image onto a recording medium; and fixing the toner image to the recording medium.

6. A process cartridge, comprising:

an image bearing member to bear an electrostatic latent image on a surface thereof; and a developing device to develop the electrostatic latent image with the developer according to claim 4 to form a toner image on the surface of the image bearing member, wherein the image bearing member and the developing device are integrated into a single unit so that the process cartridge is detachably attachable to an image forming apparatus.

7. The carrier according to claim 1, wherein the filler is at least one selected from the group consisting of aluminum oxide, titanium dioxide, zinc oxide, silicon dioxide, barium sulfate, zirconium oxide, tin dioxide, indium oxide and carbon black.

8. The carrier of claim 1, wherein the ratio of the average domain diameter of the particulate magnetic core to the number average particle diameter of the filler is from 1:0.117 to 1:0.217.

* * * * *